US005411262A

United States Patent [19]

Smith

[11] Patent Number: 5,411,262

[45] Date of Patent: May 2, 1995

[54] PUZZLES AND TOYS (II)

[76] Inventor: Michael R. Smith, 1531 1st Ave., Apt. 414, Seattle, Wash. 98101

[21] Appl. No.: 163,923

[22] Filed: Dec. 8, 1993

Related U.S. Application Data

[63] Continuation-in-part of Ser. No. 924,304, Aug. 3, 1992, abandoned.

[51] Int. Cl.[6] ..... A63F 9/08

[52] U.S. Cl. ..... 273/157 R; 273/156; 446/129; 446/118

[58] Field of Search ..... 273/157 R, 157 A, 155, 273/156, 153 R, 160; 446/92, 118, 137, 129; 52/DIG. 10; 434/301; 40/426

[56] References Cited

U.S. PATENT DOCUMENTS

| | | | |
|---|---|---|---|
| D. 280,430 | 9/1985 | Holman | 273/156 |
| 558,009 | 4/1896 | Worrall | 273/156 |
| 2,570,625 | 10/1951 | Zimmerman et al. . | |
| 3,095,668 | 7/1963 | Dorsett . | |
| 3,184,882 | 5/1965 | Vega . | |
| 3,407,530 | 10/1968 | Grant et al. . | |
| 3,481,603 | 12/1969 | Sugden | 446/118 |
| 3,854,223 | 12/1974 | Dingman, II . | |
| 3,998,004 | 12/1976 | Ehrlich . | |
| 4,040,630 | 8/1977 | Brattain | 273/157 R |
| 4,210,332 | 7/1980 | Shanin | 273/157 R |
| 4,238,905 | 12/1980 | MacGraw . | |
| 4,258,479 | 3/1981 | Roane . | |
| 4,334,870 | 6/1982 | Roane . | |
| 4,334,871 | 6/1982 | Roane . | |
| 4,365,809 | 12/1982 | Barry . | |
| 4,625,968 | 12/1986 | McDermott | 273/156 |
| 4,836,787 | 6/1989 | Boo . | |
| 4,886,273 | 12/1989 | Unger . | |
| 5,145,177 | 9/1992 | Wells | 273/157 R |

FOREIGN PATENT DOCUMENTS

| | | | |
|---|---|---|---|
| 133178 | 5/1933 | Austria | 446/118 |
| 3929190 | 1/1990 | Germany | 273/157 R |
| 2147633 | 5/1985 | United Kingdom | 446/118 |

*Primary Examiner*—V. Millin
*Assistant Examiner*—Steven B. Wong
*Attorney, Agent, or Firm*—Hughes, Multer & Schacht

[57] ABSTRACT

A magnetic toy or puzzle comprising a plurality of essentially two-dimensional pieces that may be assembled to form a hollow three-dimensional object. Each piece has at least three edges, and a magnet is mounted along each edge of each piece to allow the edges of the pieces to be joined together. The magnets are preferably keyed to allow: (a) only certain edges to attach to each other; or (b) the edges of the pieces to fit together in only one orientation. The magnets allow the edges to be joined in certain configurations to obtain the three-dimensional object. A holder for the puzzle pieces is provided that adds additional puzzle possibilities.

10 Claims, 7 Drawing Sheets

Fig. 1
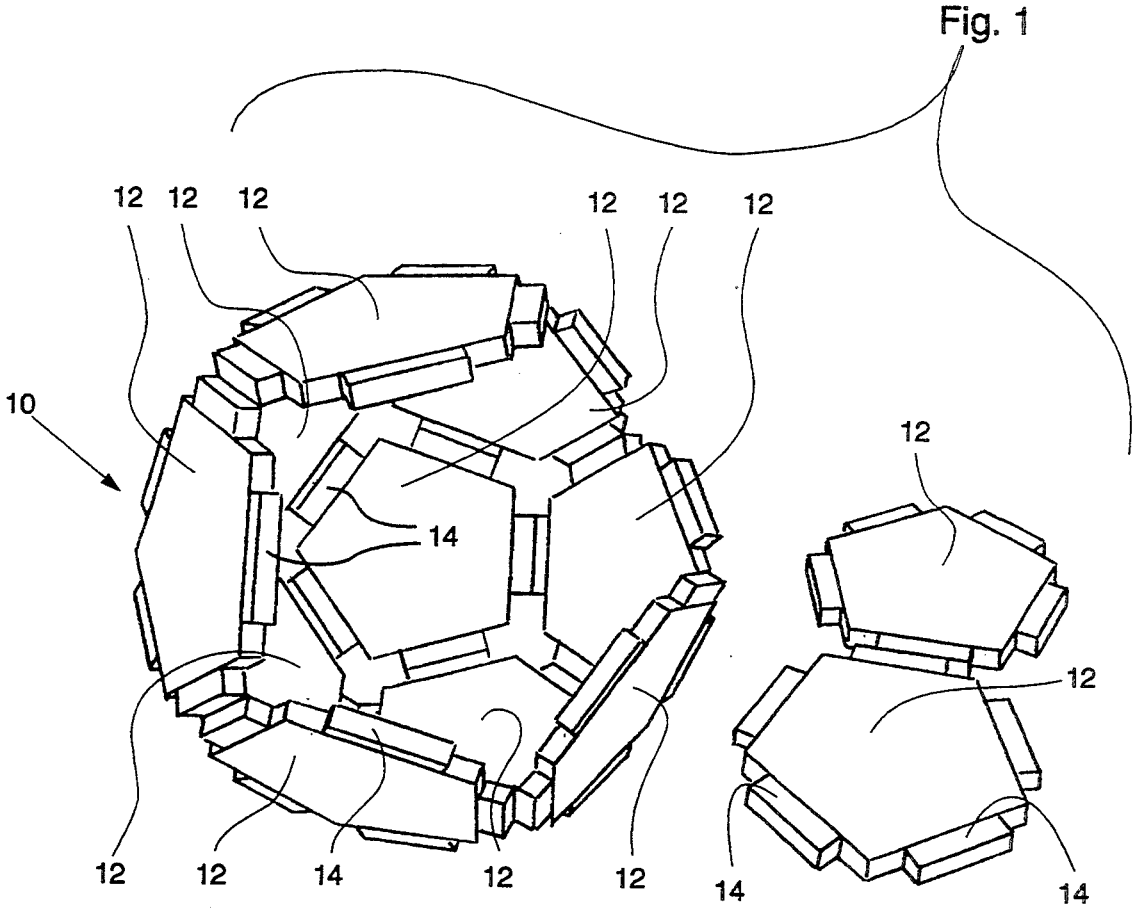
Fig. 2
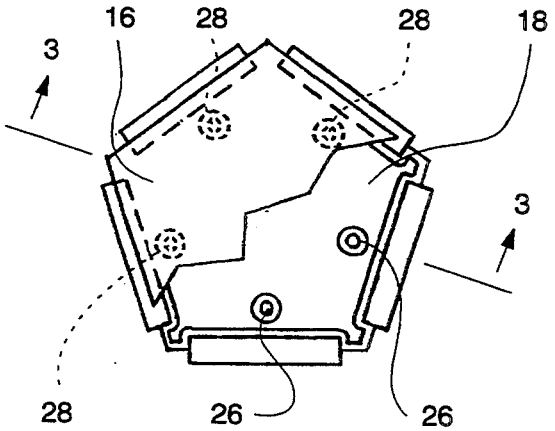
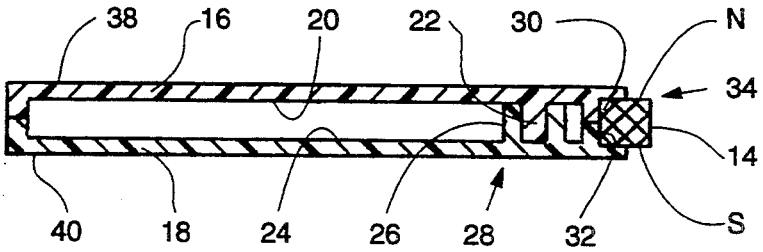
Fig. 3

Fig. 7
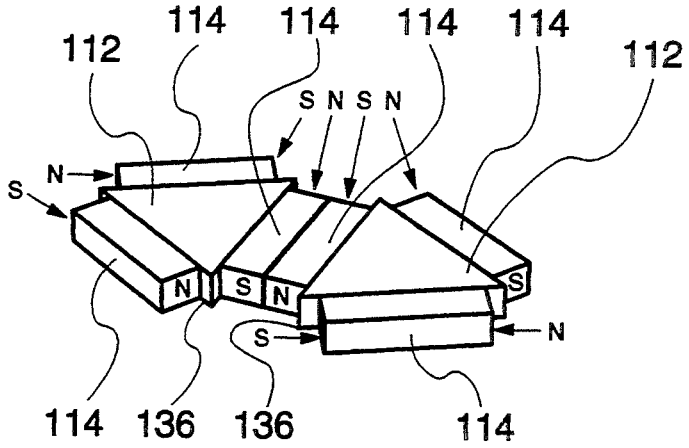
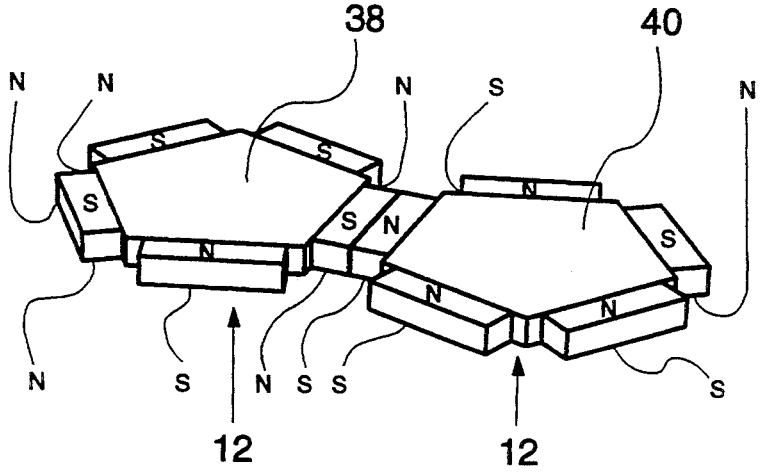
Fig. 8
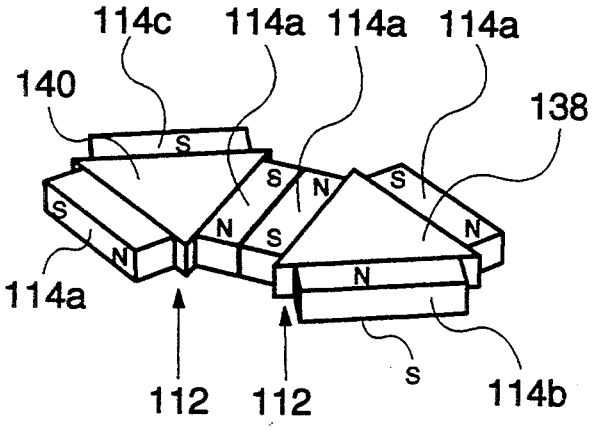
Fig. 9

Fig. 12
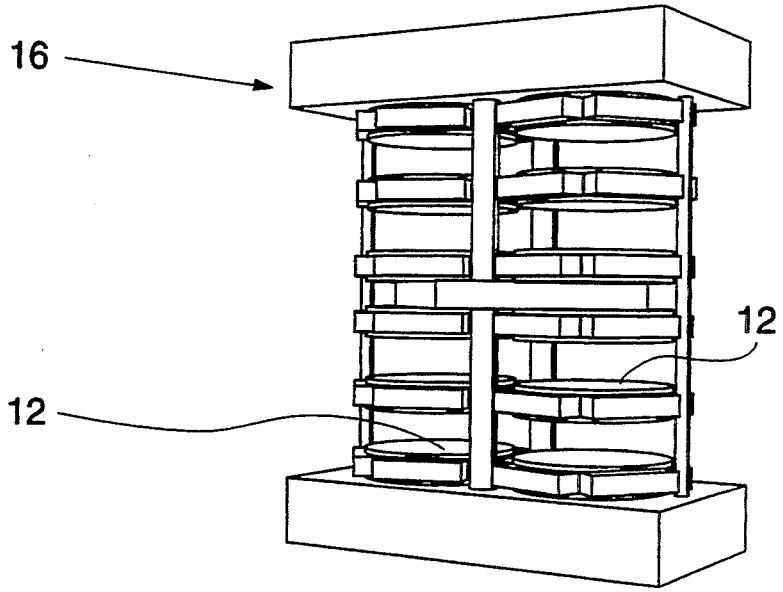
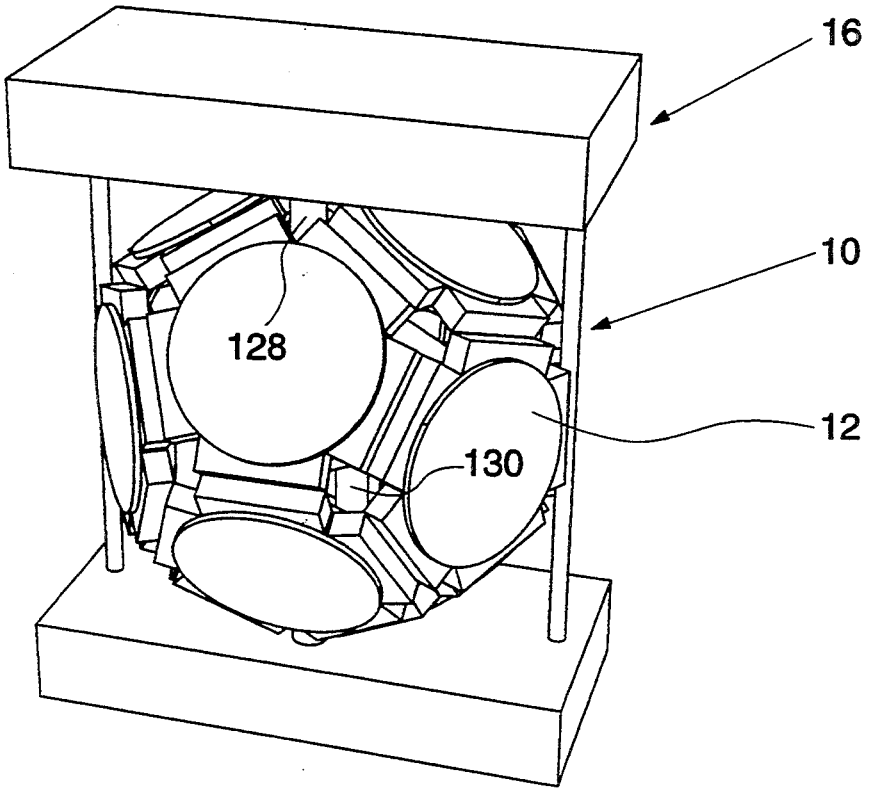
Fig. 13

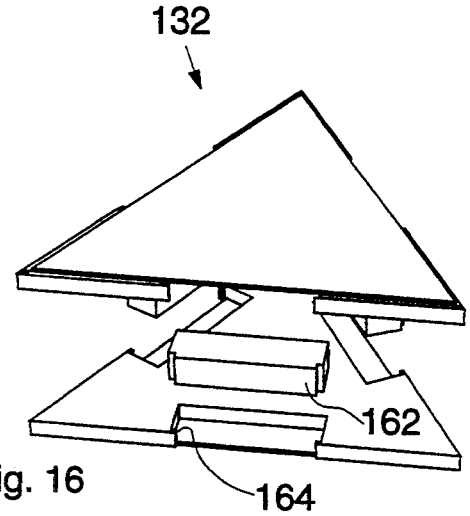
Fig. 16
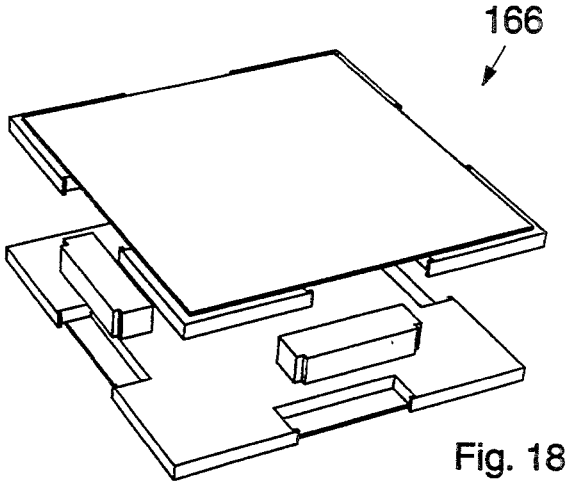
Fig. 18
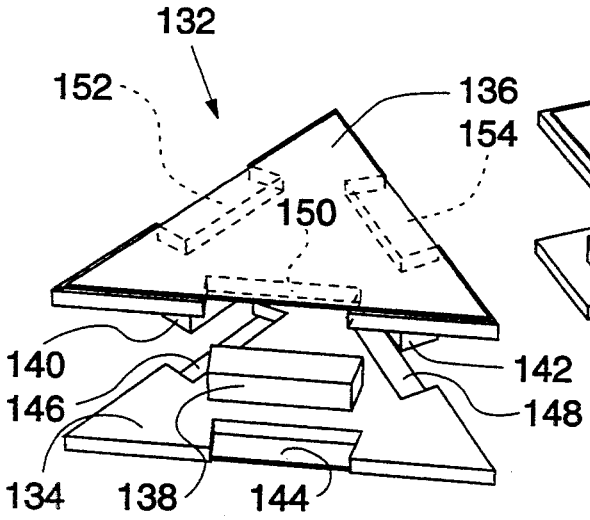
Fig. 14
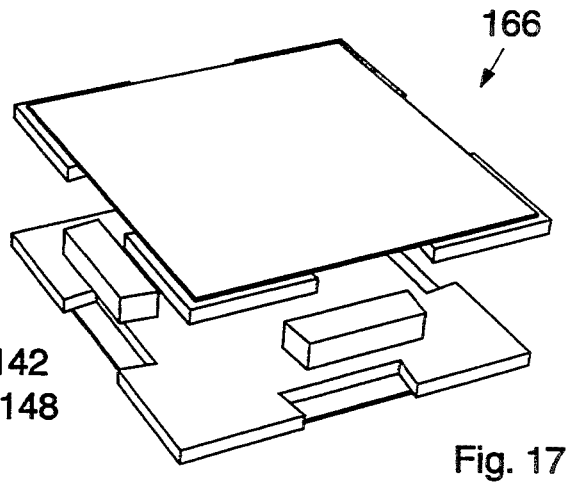
Fig. 17
Fig. 15
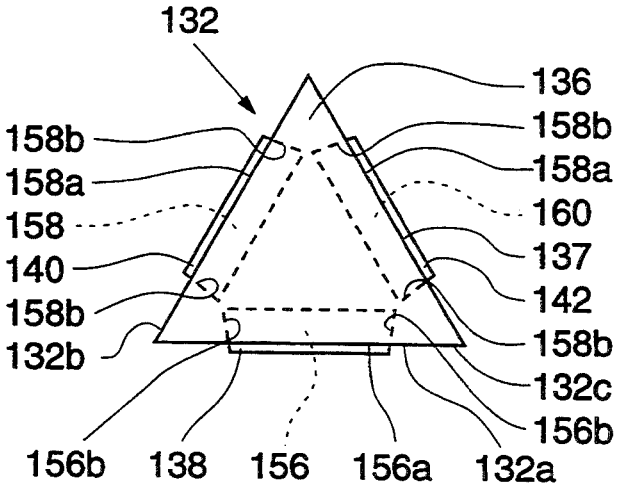

PUZZLES AND TOYS (II)

This application is a continuation-in-part of Ser. No. 07/924,304 filed Aug. 3, 1992, now abandoned.

TECHNICAL FIELD

The present invention relates to puzzles and toys, and, more particularly, to puzzles and toys that comprise individual pieces that may be joined together to form three-dimensional objects.

BACKGROUND OF THE INVENTION

A puzzle solver finds enjoyment in the challenge of assembling or arranging pieces or filling in blanks to obtain the final form or state of the successfully completed puzzle. The utility of a puzzle primarily lies in the process the puzzle solver must perform to obtain this final form or state and only incidentally in the final form or state resulting when the puzzle is successfully completed. For example, once completed, a crossword puzzle is essentially worthless; similarly, while the pieces of a jigsaw puzzle may be assembled to form an interesting or beautiful picture, jigsaw puzzles are normally disassembled when the assembly process is complete. Accordingly, the process performed is the most important aspect of a successfully designed puzzle and should present a new and interesting challenge to the puzzle solver.

The utility of toys for children generally is derived in large part from the above-mentioned factors describing the utility of a puzzle; in addition, however, a toy should be educational and allow a child to be creative.

PRIOR ART

A search of the prior art uncovered the following U.S. Pat. Nos.: (a) 4,886,273 issued 12 Dec. 1989 to Unger; (b) 4,365,809 issued 28 Dec. 1982 to Barry; (c) 4,334,871 issued 15 Jun. 1982 to Roane; (d) 4,334,870 issued 15 Jun. 1982 to Roane; (e) 4,258,479 issued 31 Mar. 1981 to Roane; (f) 4,238,905 issued 16 Dec. 1980 to MacGraw, II; (g) 3,854,223 issued 17 Dec. 1974 to Dingman, II; (h) 3,407,530 issued 29 Oct. 1968 to Grant et al.; (i) 3,095,668 issued 2 Jul. 1963 to Dorsett; and (j) 2,570,625 issued 9 Oct. 1951 to Zimmerman et al.

Of the foregoing references, the references (a) and (c)–(j) employ magnets to attach various pieces together to form a three-dimensional object. The pieces of each of these puzzles are three-dimensional before the puzzle is assembled into its final three-dimensional form.

Reference (b), the U.S. Patent to Barry, employs essentially flat or "planar" pieces that are so formed that they may be arranged to obtain various flat or "planar" geometric figures. The Barry patent does not employ means for joining the various pieces together and does not result in the creation of a three-dimensional object when the pieces are arranged.

OBJECTS OF THE INVENTION

In view of the foregoing, it should be apparent that an important object of the present invention is to provide a puzzle that presents a new and interesting challenge for the puzzle solver.

Another important, but more specific, object of the present invention is to provide puzzle apparatus and methods having a favorable mix of the following factors:

a. allows the degree of challenge presented to the puzzle solver to be increased and decreased;

b. allows several different solutions;

c. may be easily and cheaply manufactured; and h. allows the pieces thereof to be used as building block toys.

SUMMARY OF THE INVENTION

These and other objects are achieved by the present invention, which is basically a magnetic toy or puzzle comprising a plurality of essentially two-dimensional pieces that may be assembled to form a hollow three-dimensional object. Each piece has at least three edges, and an attachment means such as a magnet is mounted along each edge of each piece to allow the edges of the pieces to be joined together. The attachment means are preferably keyed to allow: (a) only certain edges to attach to each other; or (b) the edges of the pieces to fit together in only one orientation. The attachment means allow the edges to be joined in certain configurations to obtain the three-dimensional object.

The present invention provides a novel and interesting challenge to the puzzle solver for at least the following reasons: (a) the present invention allows two-dimensional pieces to be assembled to obtain a hollow three-dimensional object; (b) the present invention requires a certain amount of manual dexterity that adds to the challenge of assembling the pieces into the three-dimensional object; and (c) the present invention may be constructed in various configurations that allow the degree of challenge to be increased or decreased.

BRIEF DESCRIPTION OF THE DRAWINGS

FIG. 1 is a perspective view of a magnetic puzzle constructed in accordance with a first embodiment of the present invention;

FIG. 2 is a top plan, partial cut-away view of a puzzle of the first embodiment depicting the interior thereof;

FIG. 3 is a side, cut-away view of the first embodiment depicting the interior thereof;

FIGS. 7–9 are perspective views of pieces constructed in accordance with the first and second embodiments depicting various orientations of the magnets employed therein;

FIG. 12 is a perspective view of the puzzle and puzzle holder combination with the puzzle pieces arranged in a first, stacked arrangement relative to the holder;

FIG. 13 is a perspective view of the puzzle and puzzle holder combination with the puzzle pieces arranged in a second arrangement relative to the holder;

FIGS. 14 and 16 are perspective, exploded views of a puzzle piece constructed in accordance with a fourth embodiment of the present invention;

FIG. 15 is a top, plan view of the puzzle piece shown in FIG. 14; and

FIGS. 17 and 18 are perspective, exploded views of a puzzle piece constructed in accordance with a fifth embodiment of the present invention.

DETAILED DESCRIPTION OF THE INVENTION

First Embodiment

Figure 4:
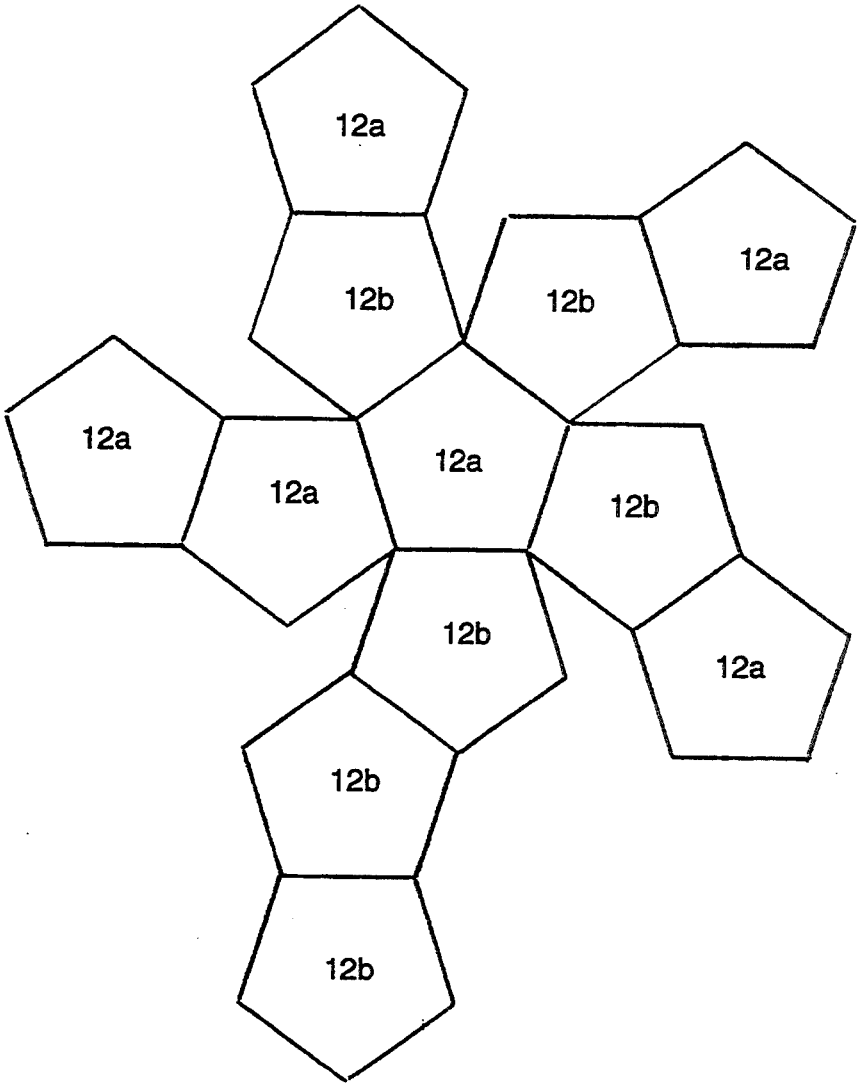
FIG. 4 is a two-dimensional layout showing one possible solution to a puzzle constructed in accordance with the first embodiment of the present invention.

Referring now to the drawing, depicted in FIG. 1 is a hollow three-dimensional object 10 embodying a first embodiment of the present invention. This object 10 is formed from a plurality of essentially two-dimensional pentagonal pieces 12. In this first embodiment, twelve pentagonal pieces 12 combine to form a dodecahedron. In FIG. 1, two of the pieces 12 are shown removed so that the interior of the object 10 is visible.

Formed on the edges of these pieces 12 are attachment means comprising magnets 14. When properly arranged, these magnets 14 attract each other to attach an edge of one of these pieces 12 to an edge on another of these pieces 12.

As shown in FIGS. 2 and 3, the pentagonal pieces 12 comprise a first portion 16 and a second portion 18 that fit together in a clam-shell-like arrangement. Extending inwardly from an inner surface 20 of each of the first portions 16 is a plurality of projections 22, while extending inwardly from an inner surface 24 of the second portions 18 are a plurality of cylindrically-shaped sockets 26. The projections 22 and sockets 26 form locking mechanisms 28 that lock the first and second portions 16 and 18 together. More particularly, the sockets 26 are arranged and dimensioned to receive and hold the projections 22 when the first and second portions 16 and 18 are aligned and pressed together.

Additionally, walls 30 and 32 inwardly extend from the first and second portion inner surfaces 20 and 24. These walls 30 and 32 and the inner surfaces 20 and 24 define magnet cavities 34. As shown in FIG. 3, these magnet cavities 34 secure the magnets 14 along the edges 36 of the pieces 12. More specifically, when the locking mechanism 28 holds the first and second portions 16 and 18 together, the first and second portion inner surfaces 20 and 24 grip the magnets 14 with sufficient force to hold the magnets 14 in place along the edges 36 of the piece 12. The magnets 14 are thus securely mounted along the edges 36 of the pieces 12.

The pieces 12 were described above as being "essentially two-dimensional." This phrase is used herein to describe a three-dimensional item that is much larger in first and second dimensions than it is in a third dimension. FIGS. 2 and 3 depict pieces 12 that are much smaller between first and second outer surfaces 38 and 40 of the first and second portions 16 and 18 than between the edges 36 of these pieces 12 in any two other orthogonal dimensions that are perpendicular to the planes defined by these outer surfaces 38 and 40. The pieces 12 are thus essentially two-dimensional.

Second Embodiment

Figure 5:
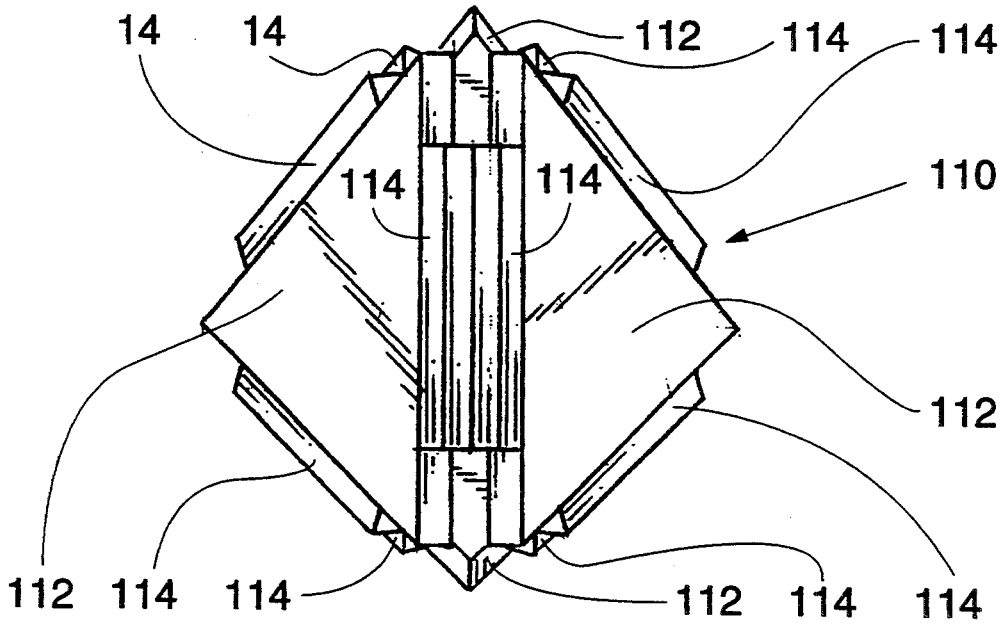
FIG. 5 is a perspective view of a magnetic puzzle constructed in accordance with a second embodiment of the present invention.

Referring now to FIG. 5, depicted therein is a hollow three-dimensional object 110 embodying a second embodiment of the present invention. Reference characters for elements of this second embodiment will be the same as for similar elements in the first embodiment plus one hundred.

The object 110 of this second embodiment is formed from a plurality of essentially two-dimensional triangular pieces 112. Specifically, four triangular pieces 112 combine to form a four sided hollow polyhedron.

As with the pieces 12 of the first embodiment, formed on the edges of these triangular pieces 112 are attachment means comprising magnets 114. When properly arranged, these magnets 114 attract each other to attach an edge of one of these pieces 112 to an edge on another of these pieces 112.

These triangular pieces 112 are constructed and assembled in substantially the same manner as the pentagonal pieces 12 of the first embodiment. A detailed discussion of the construction and assembly of the pieces 112 is therefore not necessary for a complete understanding of the second embodiment.

Third Embodiment

Figure 10:
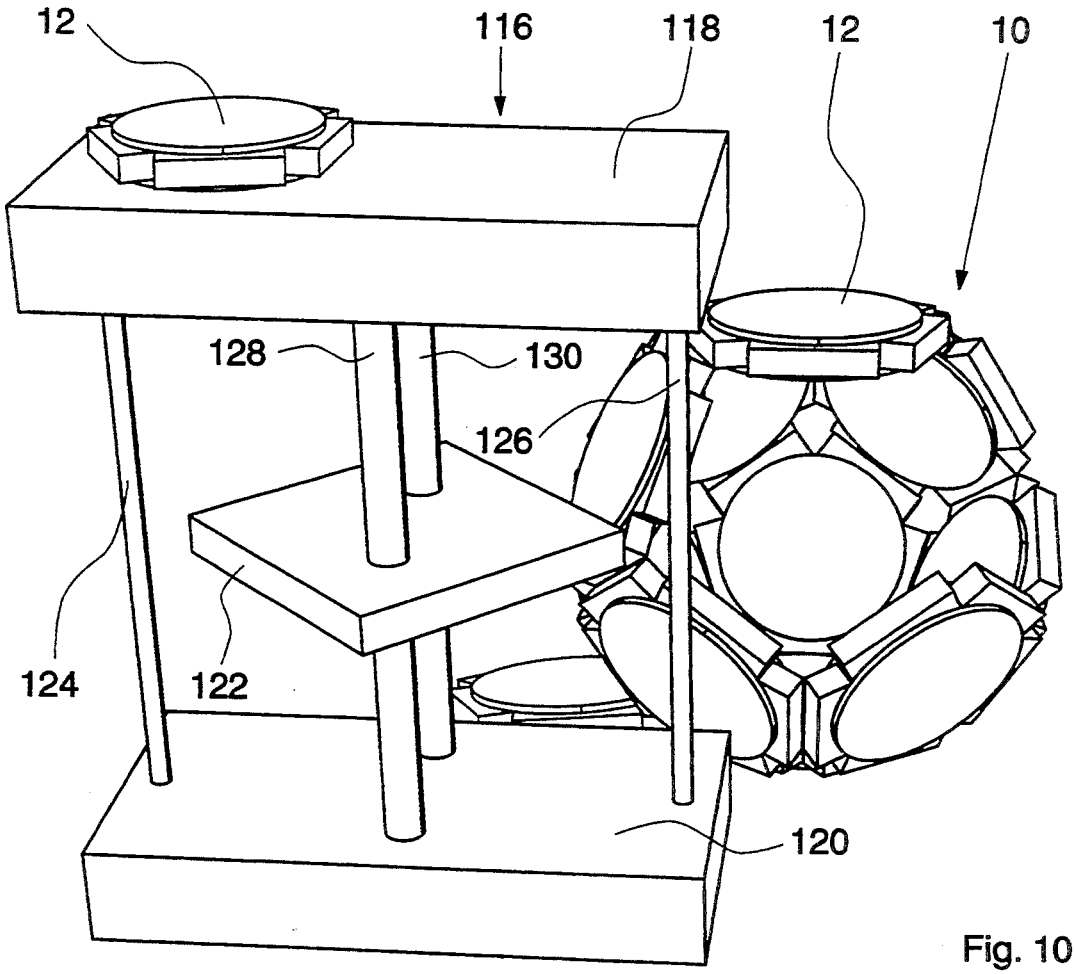
FIG. 10 is a perspective view of the puzzle and puzzle holder combination of the present invention.

Referring now to FIG. 10, depicted at 116 therein is a holder or stand for the three-dimensional object 10 shown and described in detail above. This holder 116 is designed not only to present the object 10 in a desirable manner for display purposes but to interact with the pieces 12 combined to create the object 10 in various ways to create additional puzzles.

The holder 116 comprises a top plate 118, a bottom plate 120, a middle plate 122, left and right spacing bars 124 and 126, and front and back spacing bars 128 and 130. As shown in FIG. 10, the plates 118–122 are parallel, and the spacing bars 124–130 extend between the top plate 118 and the bottom plate 120 to hold these plates in a fixed, vertically spaced relationship; the middle plate 122 is so mounted on the front and back spacing bars 128 and 130 that it is equidistant from the top and bottom plates 118 and 120.

Figure 11:
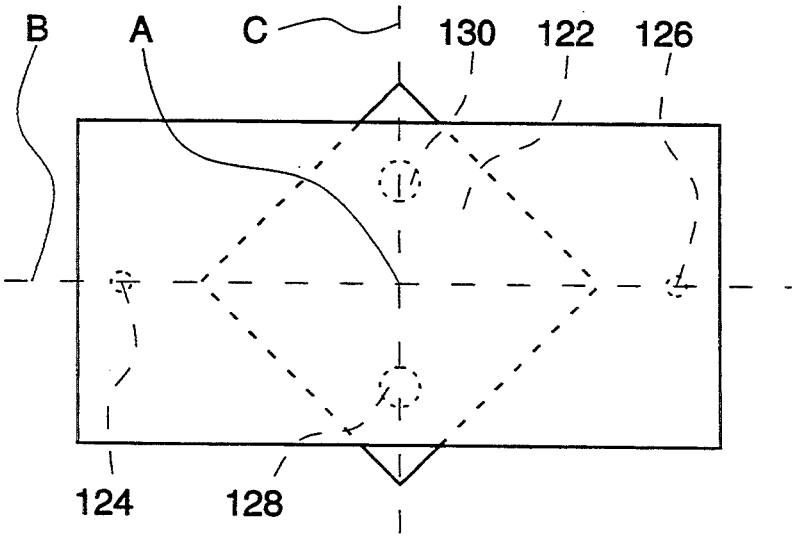
FIG. 11 is a top plan view of the holder depicted in FIG. 10.

Referring now to FIG. 11, it can be seen that the exemplary top and bottom plates 118 and 120 are rectangular, while the exemplary middle plate 122 is square. The centers of these plates 118–122 are aligned along a center axis A of the holder 116. Vertical planes B and C extend front to back and left to right, respectively, through the holder center axis A. The left and right spacing bars 124 and 126 are located in the left-to-right plane B and the front and back support members 128 and 130 are located in the front-to-back plane C such that the exemplary holder 116 is symmetrical about these planes B and C.

FIG. 11 also shows that the middle plate 122 is rotated 90° relative to the top and bottom plates 118 and 120. In other words, two corners of the middle plate 122 lie in the left-to-right plane B while two corners of the middle plate 122 lie in the front-to-back plane C; on the other hand, the left-to-right plane B bisects the left and right sides of the top and bottom plates 118 and 120, while the front-to-back plane C bisects the front and back sides of these plates 118 and 120.

While the exact orientation of plates 118–122 and spacing bars 124–130 described above yields an aesthetically pleasing and functional holder 116, the invention can be implemented with other shapes and arrangements of plates and spacing bars.

The holder 116 is shown storing the pieces 12 in a first configuration in FIG. 12 and in a second configuration in FIG. 13. In the first configuration shown in FIG. 12, the pieces 12 are spaced from each other by magnetic fields.

As shown in FIGS. 12 and 13, the holder 116 presents at least three puzzle possibilities in addition to those presented by the pieces 12 by themselves. The first puzzle is simply extracting the pieces 12 from the holder 116 when they are arranged in the configuration shown in FIG. 12. After the pieces 12 are manipulated to form the object 10, a second puzzle configuration is to place the object 10 around the front and back spacing bars 128 and 130 as shown in FIG. 13. Third, another puzzle is presented when the user attempts to put the pieces back into the configuration shown in FIG. 12.

From the foregoing, it should be clear that the exact dimensions of the plates 118–122 and spacing bars 124–130 are dictated by the size and physical layout of the pieces 12. In particular, the size and location of the front and back spacing bars 128 and 130 are dictated by the size and location of the gaps between adjacent pieces 12 when the pieces 12 are formed into the object 10; the location of the left and right spacing bars 124 and 126 is dictated by the overall dimensions of the object 10.

Further, in the exemplary holder 116, the spacing bars 124–130 are made of a non-ferrous metal or other material that will not attract the magnets. The plates 118–122 are made of wood such that they also do not interfere with the assembly of the pieces 12 onto the holder 116. However, in certain arrangements these components 118–130 may be made wholly or partially magnetically attractable or magnetic to provide additional challenge.

The middle plate 122 is provided for the following reasons. First, the distance between the top and bottom plates 118 and 120 must be large enough to accommodate the pieces 12 configured as the object 10 as shown in FIG. 13. The middle plate 122 provides intermediate support to allow the pieces 12 to be evenly spaced along the minimum allowable distance between the top and bottom plates 118 and 120. Without the middle plate 122, the weight of the top pieces presses the lower pieces together. Second, the middle plate 122 complicates the process of forming the object 10 and thus adds to the challenge of the puzzle.

Fourth Embodiment

A fourth embodiment of the present invention is shown in FIGS. 14–16. In particular, as shown in FIG. 14, a triangular piece 132 similar to the piece 112 described above comprises first and second portions 134 and 136 joined to form an assembly 137 and magnets 138, 140, and 142. Depressions 144, 146, and 148 are formed in the first portion 134, while depressions 150, 152, and 154 are formed in the second portion 136.

As shown in FIG. 15, the piece 132 is formed by joining the first and second portions 134 and 136 together such that depressions 144 and 150 form a first cavity 156, depressions 146 and 152 form a second cavity 158, and depressions 148 and 154 form a third cavity 160. The cavities 156, 158, and 160 all have a narrowed opening 156*a*, 158*a*, and 160*a*, with these openings 156*a*, 158*a*, and 160*a* arranged along the edges 132*a*, 132*b*, and 132*c* of the piece 132, respectively.

Prior to joining the first and second portions 134 and 136 together, the magnets 138, 140, and 142 are placed in the depressions 144, 146, and 148, respectively. The magnets 138, 140, and 142 are formed to fill the cavities 156, 158, and 160 and extend slightly out thereof through the cavity openings 156*a*, 158*a*, and 160*a*. Thus, by joining the first and second portions 134 and 136 together, the magnets 138, 140, and 142 are securely held within the piece 132.

The exemplary narrowed openings 156*a*, 158*a*, and 160*a* are formed by slanted end walls 156*b*, 158*b*, and 160*b* of the cavities 156, 158, and 160. However, the effect of such narrowed openings can be obtained by notch 162 in the magnet and corresponding projection 164 as shown in FIG. 17. In either case, a surface on the casing assembly 137 formed by the portions 134 and 136 engages the magnets to keep them from falling out of the assembly 137.

The casing portions 134 and 136 are formed of injection-molded plastic and are joined together to form the casing assembly by a snap fitting, by an adhesive, or ultrasonic welding.

Fifth Embodiment

Shown at 166 in FIGS. 17 and 18 is a puzzle piece constructed in accordance with a fifth embodiment of the present invention. This puzzle piece 166 is constructed and assembled in the same basic manner as the piece shown at 132 above but is square rather than triangular. In FIG. 17, the magnets are held within the casing assembly by slanted walls as in FIG. 14 above, and in FIG. 18 the magnets are notched to mate with corresponding projections in the case portions as in FIG. 16 above.

Orientation of Magnets

In the following discussion and the drawings, "N" is used to indicate a north pole and "S" is used to indicate a south pole.

The magnets 14 and 114 described above may be oriented on the edges of the pieces 12 and 112 according to three different factors: (a) the surfaces of the magnets on which the poles of the magnets are formed; (b) the arrangement of the magnetic poles in relation to the piece on which the magnet is mounted; and (c) the number of poles on each magnet. Three of the many possible orientations allowed by these factors are depicted in FIGS. 7, 8, and 9.

Figure 6:
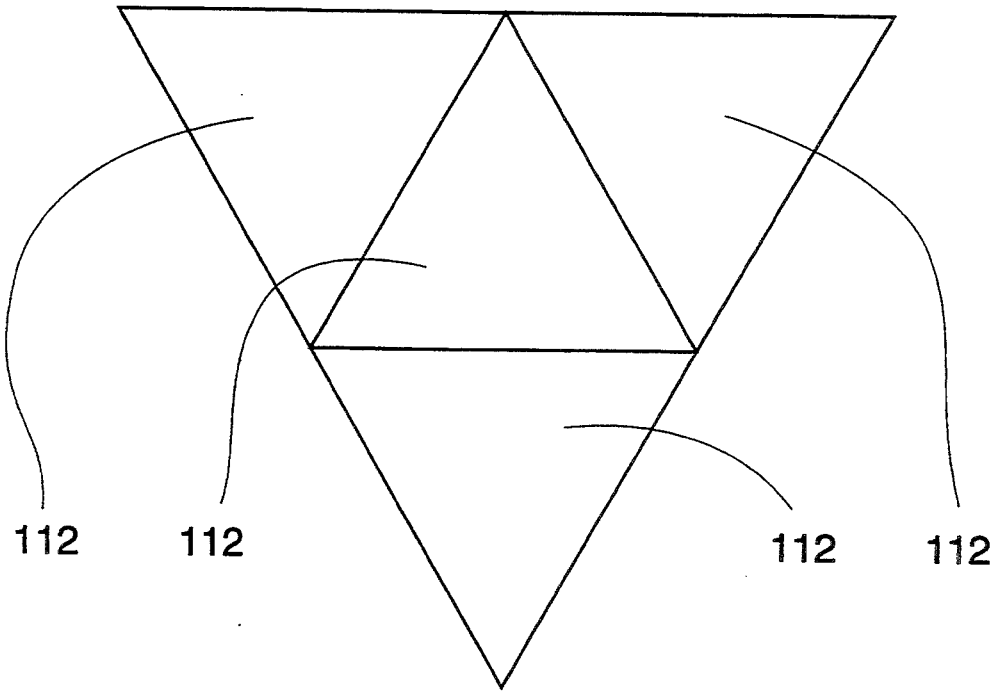
FIG. 6 is a two-dimensional layout showing one possible solution to a puzzle constructed in accordance with the second embodiment of the present invention.

In FIG. 7, the magnet 114 employed is an alnico magnet having poles formed on the ends 142 thereof. Magnets 114 having poles arranged in this manner allow any edge 136 of any given piece 112 to be attached to any other edge 136 on any other piece 112. This orientation of poles is preferable for use in constructing a piece 112 robe used as a toy, but an alnico magnet is more expensive than magnets having poles arranged on other surfaces. One solution to the first magnet orientation depicted in FIG. 7 is shown in two dimensions in FIG. 6.

In FIG. 8, magnets known as "ceramic 5" magnets are employed. These magnets are arranged to have poles formed on surfaces parallel to the first and second surfaces 38 and 40 of the pieces 12 (FIG. 3). A three-dimensional object such as the object 10 is formed from 12 pieces such as those depicted in FIG. 8.

For example, with pentagonal shaped piece such as the piece 12 of the first embodiment, such "ceramic 5" magnets may be so placed in a first arrangement that four south poles and one north pole are adjacent to the first surface 38 and four north poles and one south pole are adjacent to the second surface 40. Therefore, with this first arrangement, the pieces may be so arranged that: (a) a first group contains six first pieces 12*a* that are arranged to have their first surfaces 38 arranged facing upwardly; and (b) a second group contains six second pieces 12*b* that may be arranged to have their second surfaces 38 arranged facing upwardly. One possible solution to this first arrangement is shown in two dimensions in FIG. 4.

Alternatively, in such a pentagonal piece, these "ceramic 5" magnets may be so placed in a second arrangement in which three south poles and two north poles are adjacent to the first surface 38 and three north poles and two south poles are adjacent to the second surface 40. With magnets arranged in this manner, the pieces may be arranged in: (a) a first group containing six first pieces having the first surfaces 38 arranged upwardly; and (b) a second group contain six second pieces having second surfaces 40 arranged upwardly.

Given that the goal is to combine the pieces to form a dodecahedron, the second arrangement described above presents more possible solutions than the first such arrangement.

In the pieces 112 depicted in FIG. 9, both single pole and multiple pole "ceramic 5" magnets are employed with the triangular pieces 112. First magnets indicated at 114*a* contain both north and south poles along surfaces parallel to the edges 136 of the pieces 112. Second magnets indicated at 114*b* contain magnets 114 having north poles along surfaces parallel to the piece first surfaces 138, while third magnets indicated at 114*c* having south poles parallel to the piece second surfaces 140. As shown in FIG. 9, the first magnets 114*a* will be correctly attracted only to other first magnets 114*a* and only when the pieces 112 are correctly oriented in relation to each other. The second magnets 114*b* will be correctly attracted only to third magnets 114*c* and will not be correctly attracted either to the first magnets 114*a* or to other second magnets 114*b*. Similarly, the third magnets 114*c* will only be attracted to second magnets 114*b*.

Accordingly, with variations on magnet orientation such as those described above and depicted in FIG. 9, even the process of assembling triangular pieces 112 into the simple geometric shape shown in FIG. 5 can be quite challenging to the puzzle solver. Applying the various orientations shown in FIG. 9 to more complex geometric shapes such as the pentagonal pieces 12 that are assembled into a dodecahedron can result in almost any degree of complexity of the process of solving the puzzle.

Educational Aspects

The pieces 12 and 112 can be used to teach a child about magnets by appropriately labeling the pieces as shown in FIG. 8. The child can learn about magnetic attraction and at the same time develop motor control skills when assembling the pieces as building blocks into the three-dimensional object. When the pieces are to be used as building blocks, triangular and square pieces are preferable, and the magnets should not be keyed. This allows the pieces to be put together in a large number of configurations.

Other Considerations

In the above embodiments, the pieces 12 and 112 comprised first and second portions that are locked together and the magnets 14 and 114 are held in place by friction. This assembly method allows the pieces 12 to be packaged as part of a puzzle that enables the puzzle solver to mix and match magnets with pieces in different orientations; the puzzle solver may thus take part in designing the puzzle itself and thus control the level of the challenge in solving the puzzle.

In other situations, however, the pieces 12 and 112 may be more appropriately made out of more expensive or exotic material such as wood or glass, and adhesives may be used to glue the magnets in place. For example, certain puzzle solvers collect fine puzzles, and a puzzle made of more substantial or aesthetically pleasing materials may be highly desirable to such puzzle collectors.

Conclusion

It should be clear that the present invention may be embodied in forms other than those described above. The above-described embodiments are therefore to be considered in all respects illustrative and not restrictive, the scope of the invention being indicated by the appended claims rather than the foregoing description. All changes that come within the meaning and scope of the claims are intended to be embraced therein.

I claim:

1. A combination of:

a. a plurality of pieces, each piece having at least three edges, where attachment means are so formed on the edges that the pieces may be joined together to construct a completed form; and b. a holder having first and second plates held in a spaced apart relation by a plurality of support members, where the plates and support members are arranged such that the pieces can be stored individually in the holder in a stacked configuration and can be stored in the holder joined together as the completed form with the support members extending through the completed form.

2. A combination as recited in claim 1, in which the attachment means comprises magnetic means for joining edges together with magnetic force.

3. A combination as recited in claim 2, in which poles of the magnetic means are so oriented that the edges may be magnetically joined together only in certain configurations.

4. A combination as recited in claim 2, in which the pieces have two sides, and means are formed on at least one of these sides for indicating an orientation of poles of the magnetic means.

5. A combination as recited in claim 2, in which the pieces comprise first and second portions that may be locked together in a manner that allows an end user to mount the magnetic means along the edges of the pieces in various orientations.

6. A combination as recited in claim 1, in which the sides of said pieces are of equal length and the attachment means allow the edges of the pieces to be joined together to form a three-dimensional geometric object.

7. A combination as recited in claim 1, in which the attachment means are keyed to allow any given edge to be joined to only certain of the other edges.

8. A combination as recited in claim 1, in which the holder further comprises a middle plate mounted on at least one support member between the first and second plates.

9. A combination as recited in claim 1, in which the holder comprises first, second, third, and fourth support members so arranged along front, back, left, and right edges of the first and second plates that the holder is symmetrical about a vertical axis extending through its center.

10. A method of assembling a three-dimensional puzzle, comprising the steps of:

a. providing a plurality of pieces, each piece having at least three edges;

b. forming attachment means on the edges such that the pieces may be joined together to construct a completed form; and c. providing a holder having first and second plates held in a spaced apart relation by a plurality of support members;

d. stacking the pieces in the holder in a stacked configuration;

e. removing the pieces from the holder;

f. assembling the pieces into the completed form separate from the holder;

g. assembling the pieces into the completed form such that the support members extend between at least two of the pieces; and h. restacking the pieces in the holder in the stacked configuration.

* * * * *